US007369087B2

(12) United States Patent
Tung

(10) Patent No.: US 7,369,087 B2
(45) Date of Patent: May 6, 2008

(54) ANTENNA ASSEMBLY AND ELECTRONIC DEVICE UTILIZING THE SAME

(75) Inventor: Hao-Chun Tung, Jinmen County (TW)

(73) Assignee: BENQ Corporation, Taoyuan (TW)

( * ) Notice: Subject to any disclaimer, the term of this patent is extended or adjusted under 35 U.S.C. 154(b) by 0 days.

(21) Appl. No.: 11/430,931

(22) Filed: May 10, 2006

(65) Prior Publication Data

US 2006/0256021 A1 Nov. 16, 2006

(30) Foreign Application Priority Data

May 12, 2005 (TW) ..... 94115384 A

(51) Int. Cl.
*H01Q 1/38* (2006.01)

(52) U.S. Cl. ..... 343/700 MS; 343/702

(58) Field of Classification Search ..... 343/700 MS, 343/702, 841

See application file for complete search history.

(56) References Cited

U.S. PATENT DOCUMENTS

| | | | | |
|---|---|---|---|---|
| 6,184,833 | B1 * | 2/2001 | Tran | 343/700 MS |
| 6,507,318 | B2 * | 1/2003 | Ito et al. | 343/702 |
| 6,927,730 | B2 * | 8/2005 | Tang et al. | 343/700 MS |
| 7,106,257 | B2 * | 9/2006 | Liu et al. | 343/700 MS |
| 7,183,979 | B1 * | 2/2007 | Liu et al. | 343/700 MS |
| 2002/0126051 | A1 * | 9/2002 | Jha | 343/702 |
| 2003/0025637 | A1 * | 2/2003 | Mendolia et al. | 343/702 |

* cited by examiner

*Primary Examiner*—Tan Ho
(74) *Attorney, Agent, or Firm*—Birch, Stewart, Kolasch & Birch, LLP

(57) ABSTRACT

An antenna and an electronic device utilizing the same are disclosed. The antenna includes a transmission element, a grounding board and a feed element. The grounding board is parallel to the transmission element and has a first surface, a second surface and a through hole. The first surface faces the transmission element and the second surface is opposite the first surface. The feed element connects the transmission element, passes through the through hole and abuts the second surface.

19 Claims, 8 Drawing Sheets

ANTENNA ASSEMBLY AND ELECTRONIC DEVICE UTILIZING THE SAME

BACKGROUND

The invention relates to an antenna assembly, and in particular to an antenna assembly utilized in an electronic device.

In recent years, mobile electronic devices, such as cellular phones, have become widely popular. Antenna assembly performance is critical in the mobile electronic devices operation.

Referring to FIG. 1A, a conventional antenna assembly 1 disposed in an electronic device comprises a transmission element 11, a grounding board 12, a base 13 and a feed pin 14. The grounding board 12 is disposed above the transmission element 11, having a first surface 121 and a second surface 122. The grounding board 12, for example, can be a printed circuit board in a cellular phone. The base 13 disposed between the transmission element 11 and the first surface 121 may be plastic with low dielectric constant to support the transmission element 11. The transmission element 11 has a feed point 113, the first surface 121 has a connection point 123, and the feed pin 14 is bonded to the connection point 123, contacting the feed point 113.

The antenna assembly 1 presents the following shortcomings. The feed pin is expensive and easily damaged, and does not securely connect to the feed point 113, affecting the quality of transmission.

Referring to FIG. 1B, another conventional antenna assembly 1' is shown, unlike antenna assembly 1, utilizing a feed spring 14' integrally formed with the transmission element 11. The feed spring 14' has a flexible portion 141 contacting the connection point 123.

The antenna assembly 1', while decreasing the cost of the feed pin and bonding process described in antenna assembly 1, is difficult to position and the spring force of the feed spring 14' is hard to control.

SUMMARY

Accordingly, the present invention provides an antenna assembly and an electronic device utilizing the same, comprises a shield and antenna assembly disposed therein.

The antenna assembly comprises a transmission element, a grounding board and a feed element. The grounding board is parallel to the transmission element and has a first surface, a second surface and a through hole. The first surface faces the transmission element and the second surface is opposite the first surface. The feed element connects the transmission element, passes through the through hole and then abuts the second surface.

The feed element comprises a body comprising a substantially longitudinal profile, perpendicular to the first surface and passing through the through hole.

The feed element further comprises an abutting portion connected to the body, passing through the through hole to abut the second surface.

The abutting portion is flexible with respect to the body to abut the second surface.

The abutting portion comprises a first section and a second section connected to the first section, the first section and the second section forming a V-shaped structure.

The abutting portion comprises a substantially curved profile.

The body comprises a neck adjacent to the abutting portion. When the abutting portion abuts the second surface, the through hole encircles the neck.

An aperture of the through hole exceeds the width of the neck, such that a gap exists between the feed element and the grounding board.

The height of the neck exceeds the thickness of the grounding board.

The through hole has a first length in a first direction, a second length in a second direction, and the first length exceeds the second length.

The width of the body is substantially equal to the first length.

The width of the neck is less than the first and second lengths.

The abutting portion rotates in a third direction with respect to the body to abut the second surface, and an angle exists between the first and third directions.

The antenna assembly further comprises an insulator disposed between the transmission element and the grounding board.

The transmission element has a feed point, the grounding board has a connection point, and the feed element abuts the feed point and the connection point.

A detailed description is given in the following embodiments with reference to the accompanying drawings.

DESCRIPTION OF THE DRAWINGS

The invention can be more fully understood by reading the subsequent detailed description in conjunction with the examples and references made to the accompanying drawings, wherein.

DETAILED DESCRIPTION

Figure 1A:
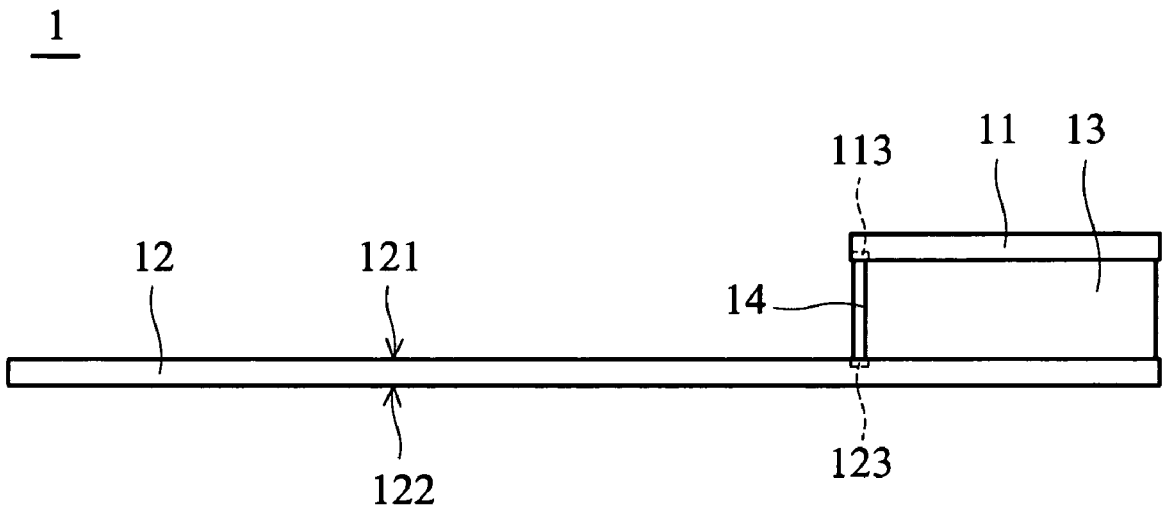
FIG. 1A ( RELATED ART )
FIG. 1A is a schematic view of a conventional antenna assembly.
Figure 1B:
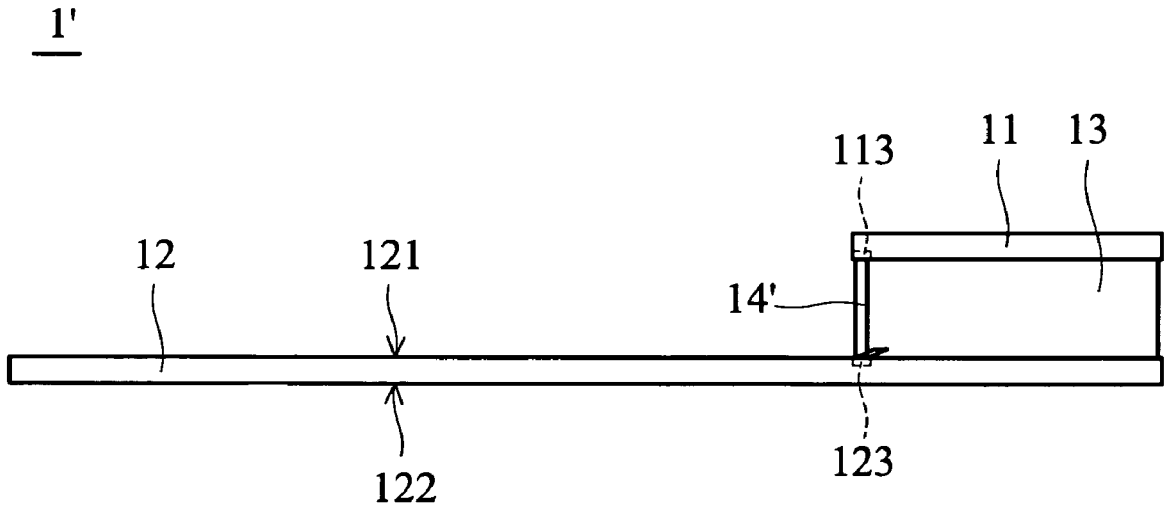
FIG. 1B ( RELATED ART )
FIG. 1B is a schematic view of another conventional antenna assembly.
Figure 2:
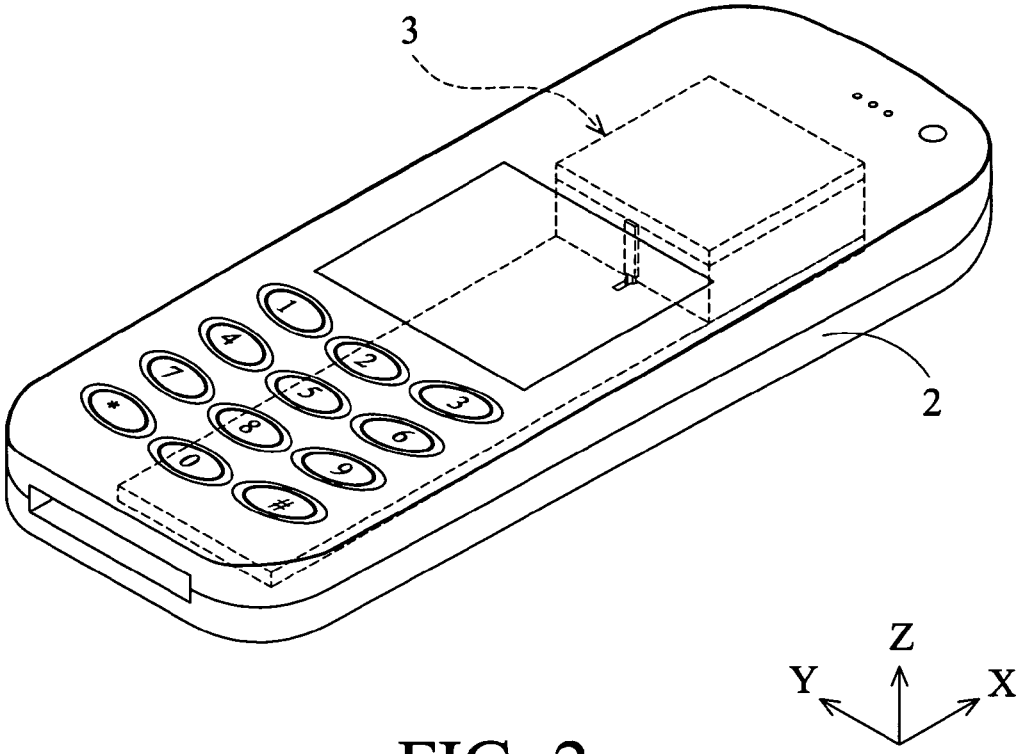
FIG. 2 is a schematic view of an electronic device of the invention.

Referring to FIG. 2, an electronic device of the invention, such as a cellular phone, comprises a shield 2 and an antenna assembly 3 disposed therein.

Figure 3:
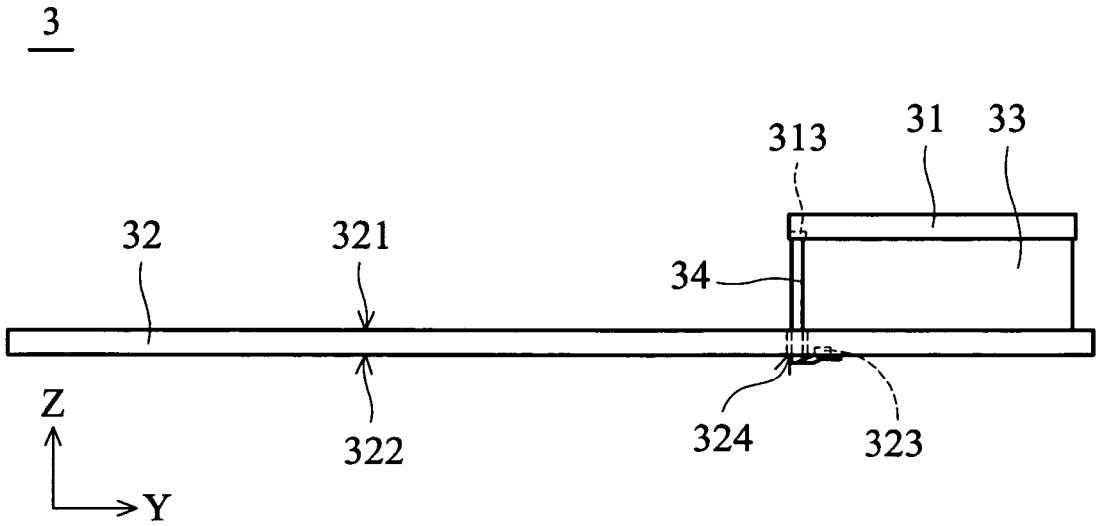
FIG. 3 is a schematic view of an antenna assembly of the invention.

FIG. 3 depicts the antenna assembly 3 of FIG. 2 along X-Z plane. The antenna assembly 3 comprises a transmission element 31, a grounding board 32, an insulator 33 and a feed element 34. The transmission element 31 is a metal plate to transfer electromagnetic waves. The grounding board 32 is a printed circuit board (PCB) in the electronic device. The grounding board 32 is parallel to and separated from the transmission element 31. The insulator 33 is disposed between the transmission element 31 and the grounding board 32. The insulator 33 may have a low dielectric constant.

The grounding board 32 has a first surface 321 and a second surface 322. The first surface 321 faces the transmission element 31 and the second surface 322 is opposite the first surface 321. A connection point 323 is formed on the second surface 322. The grounding board 32 further has a through hole 324. The transmission element 31 has a feed point 313. An end of the feed element 34 connects the feed point 313, and the other end passes through the through hole 324 to abut the connection point 323 on the second surface 322. The feed element 34 may thus receive radio circuit from the connection point 323 for transfer to the transmission element 31, emitting electromagnetic waves, and vice versa.

Figure 4A:
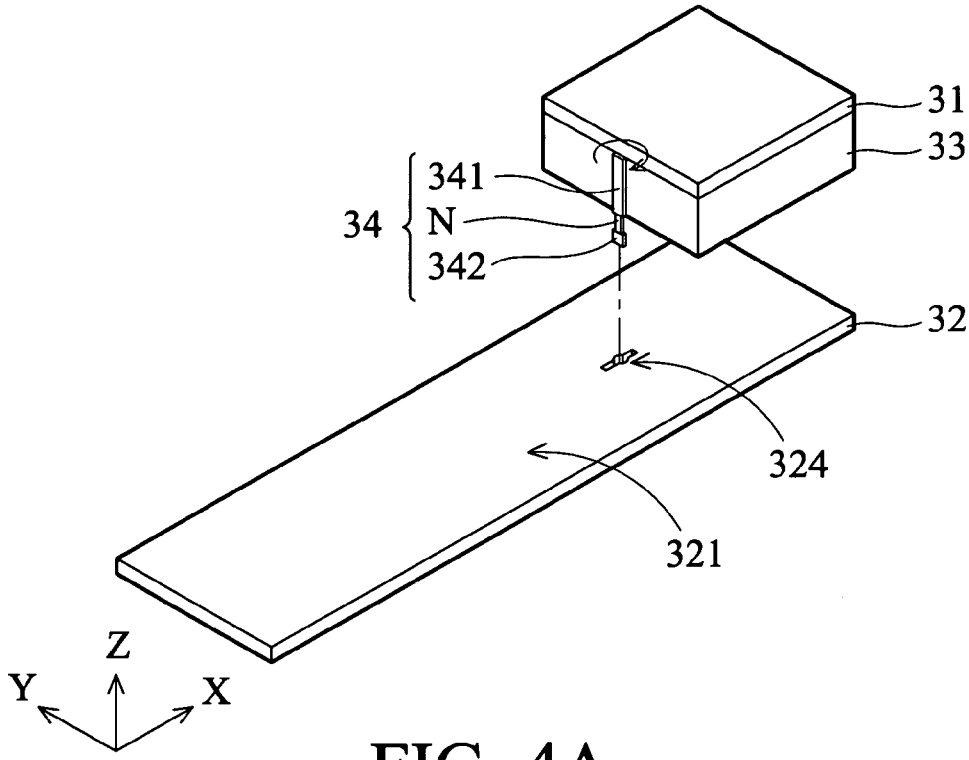
FIG. 4A is a schematic view of an antenna assembly of the invention when assembled.

FIGS. 4A to 4D depict the antenna assembly when assembled. In FIG. 4A, the transmission element 31 and the insulator 33 are connected, and an end of the feed element 34 is connected to the feed point (not shown) on the transmission element 31. The first surface 321 faces the transmission element 31 and the insulator 33. The transmission element 31 and the insulator 33 rotate clockwise along Z axis, as shown in FIG. 4A. Additionally, the feed element 34 has a body 341 and an abutting portion 342. The body 341 comprises a substantially longitudinal profile and has a neck N adjacent to the abutting portion 342. The abutting portion 342 connects the body 341.

Figure 4B:
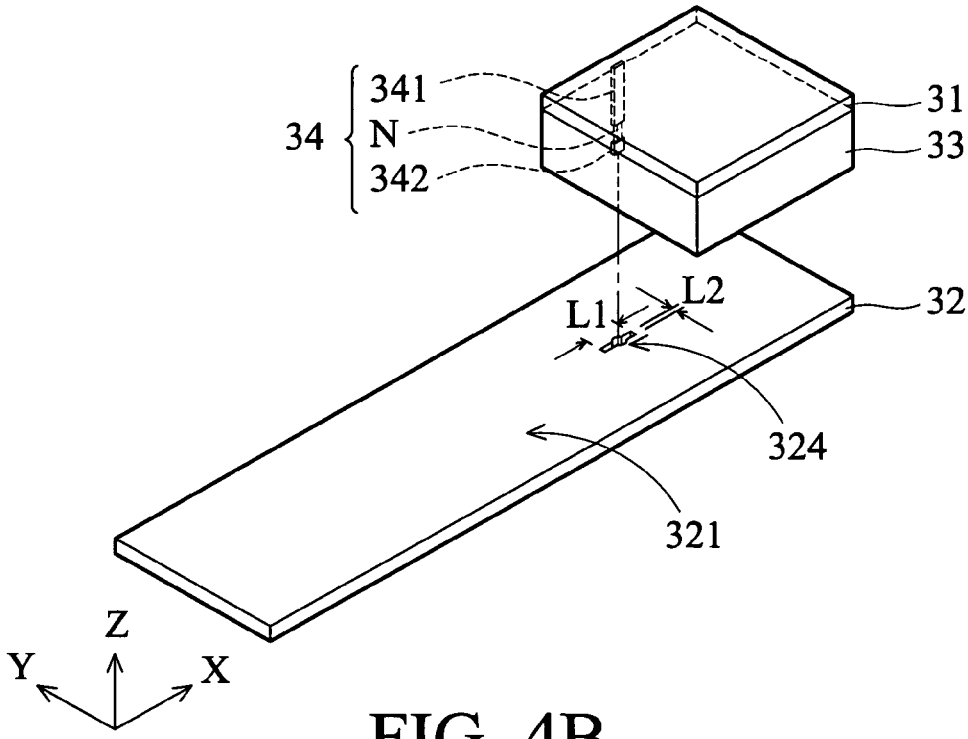
FIG. 4B is another schematic view of an antenna assembly of the invention when assembled.

FIG. 4B depicts the transmission element 31 and the insulator 33 rotating along Z axis. The feed element 34 is aligned with the through hole 324 of the grounding board 32. The abutting portion 342 of the feed element 34 passes through the through hole 324 along Z axis. The through hole 324 positions the feed element 34.

Figure 4C:
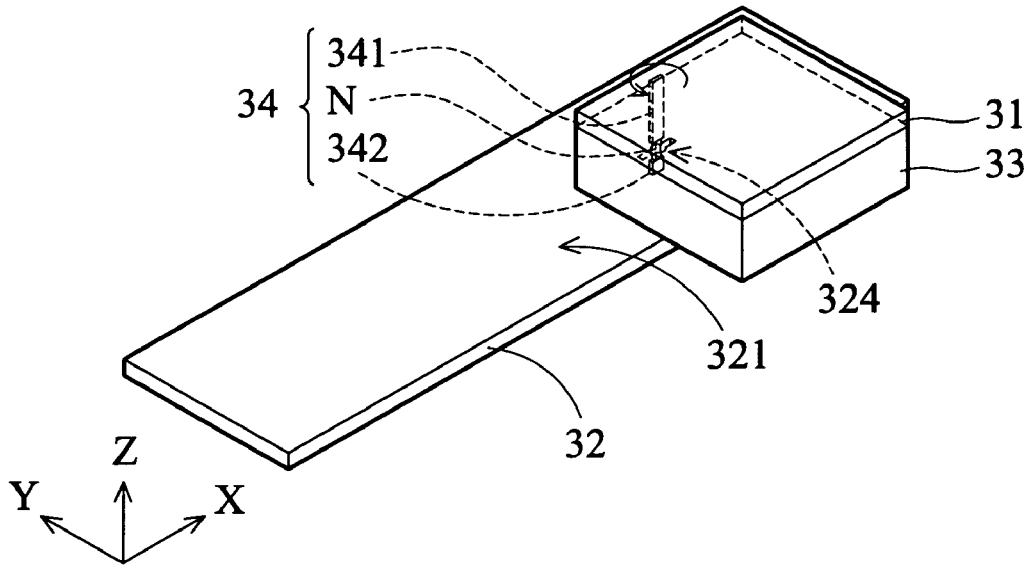
FIG. 4C is another schematic view of an antenna assembly of the invention when assembled.

FIG. 4C depicts the feed element 34 passing through the through hole 324. The abutting portion 342 passes through the through hole 324, and the neck N is placed near the through hole 324, which encircles the neck N accordingly. The transmission element 31 and the insulator 33 then rotate counter clockwise along Z axis, as shown in FIG. 4C.

As mentioned, referring to FIGS. 4B and 4C, the through hole 324 of the grounding board 32 has a first length L1 along the X axis (first direction), and a second length L2 along the Y axis (second direction). The width of the body 341 of the feed element 34 is substantially equal to the first length L1, and exceeds the second length L2, so that the feed element 34 is not easily separated from the grounding board 32. Furthermore, the width of the neck N is less than the aperture of the through hole 324, so that a gap exists between the feed element 34 and the grounding board 32. Namely, the width of the neck N is less than the first length L1 and the second length L2, and the height of the neck N exceeds the thickness of the grounding board 32 to avoid short circuit caused.

Figure 4D:
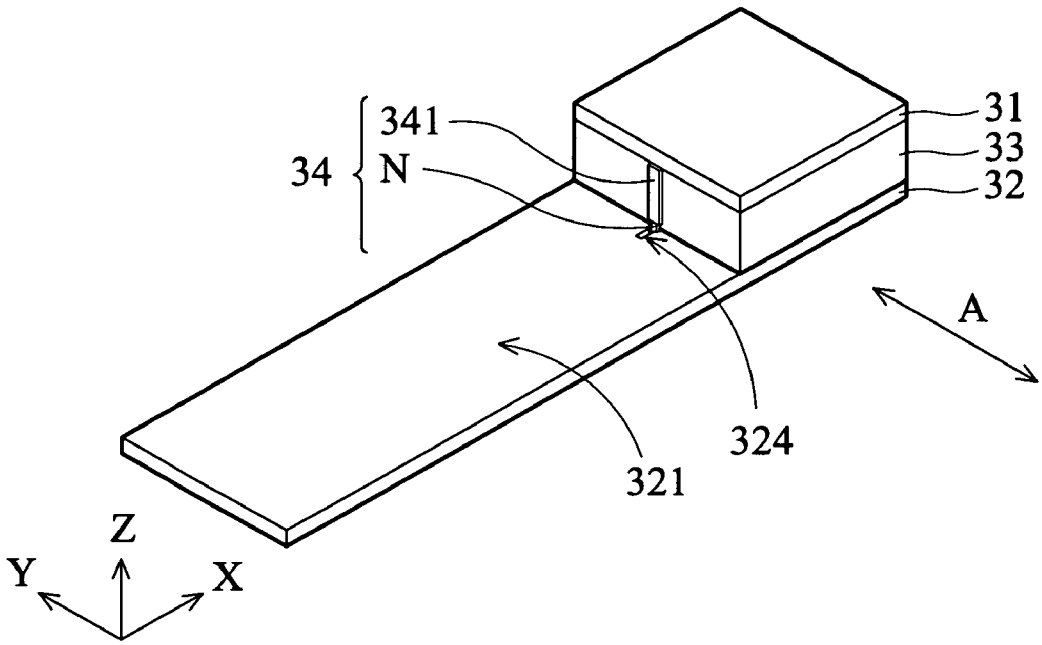
FIG. 4D is another schematic view of an antenna assembly of the invention when assembled.

FIG. 4D depicts the transmission element 31 and the insulator 33 rotating along Z axis. The abutting portion 342 of the feed element 34 then rotates along a direction A (third direction) to abut the connection point (not shown) on the second surface 342 of the grounding board 32.

The direction A disclosed here is parallel to the Y axis, but is not limited thereto, as long as an angle is formed between direction A and the X axis (direction A not parallel to the X axis) to prevent the feed element 34 from easily separating from the grounding board 32.

Figure 5B:
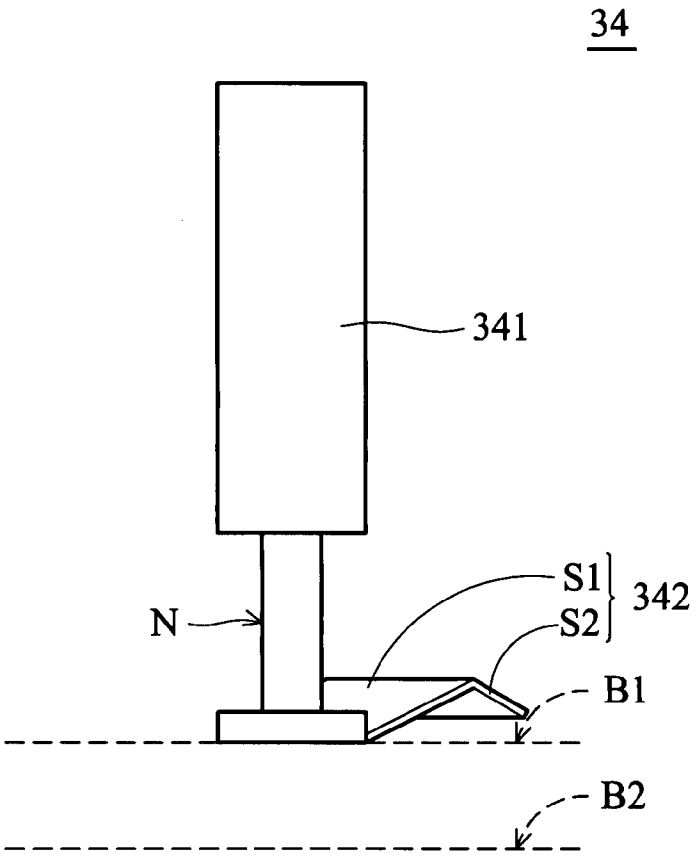
FIG. 5B is another schematic view of the feed element in FIG. 5A.
Figure 5A:
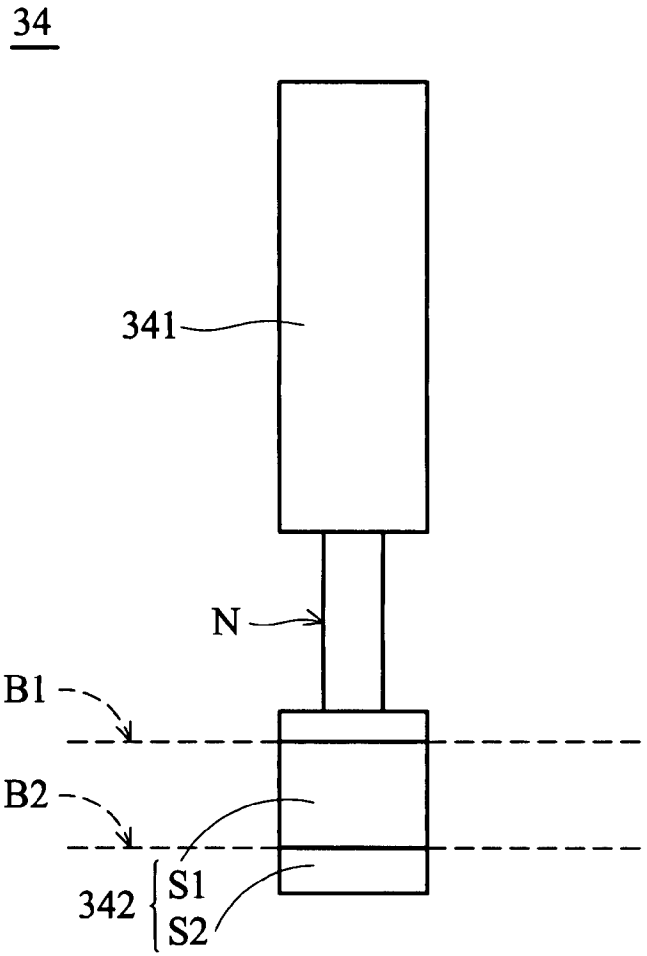
FIG. 5A is a schematic view of a feed element in an antenna assembly of the invention.

FIGS. 5A and 5B depict two samples of feed element 34, which comprises a body 341 and an abutting portion 342. The body 341 has a neck N. The abutting portion 342 comprises a first section S1 and a second section S2. The first section S1 connects the body 341 and the second section S2. As shown in FIG. 5A, a first fold line B1 is formed between the body 341 and the first section S1, and a second fold line B2 between the first section S1 and the second section S2. The abutting portion 342 folds along the first fold line B1 with respect to the body 341. The second section S2 then folds along the second fold line B2 with respect to the first section S1. Therefore, the feed element 34 is shaped as FIG. 5B, with the first section S1 and the second section S2 forming a V-shape, such that the abutting portion 342 abuts the second surface 322 of the grounding board 32.

Figure 6B:
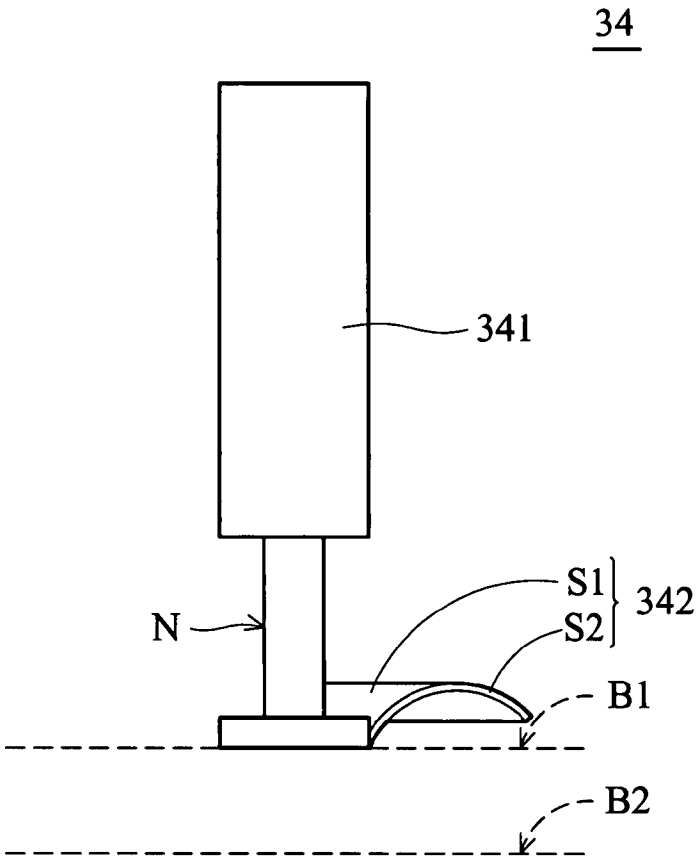
FIG. 6B is another schematic view of the feed element in FIG. 6A.
Figure 6A:
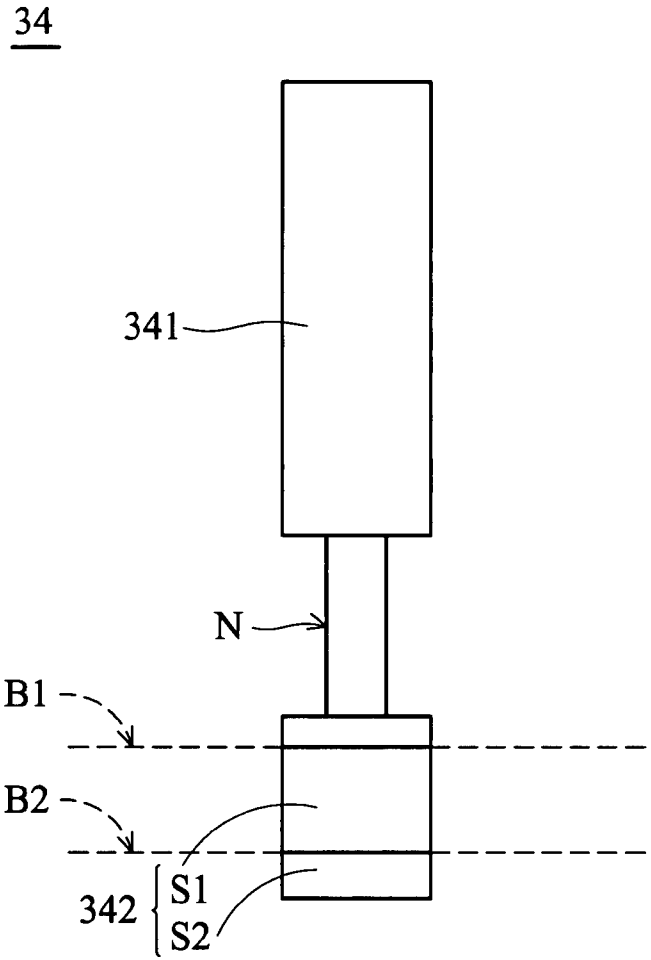
FIG. 6A is a schematic view of another feed element in an antenna assembly of the invention.
Figure 7B:
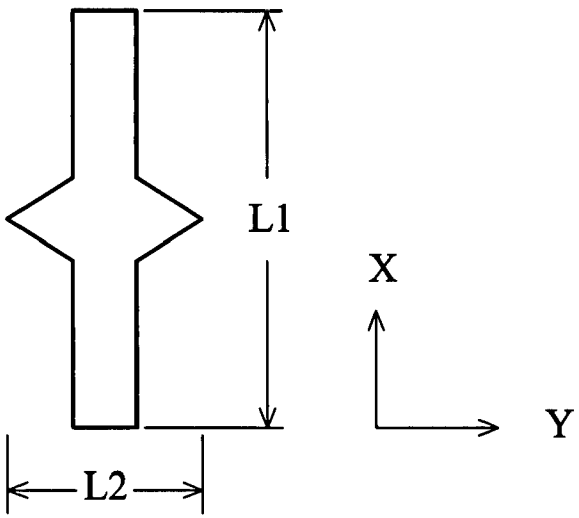
FIG. 7B is a schematic view of another through hole in an antenna assembly of the invention.
Figure 7A:
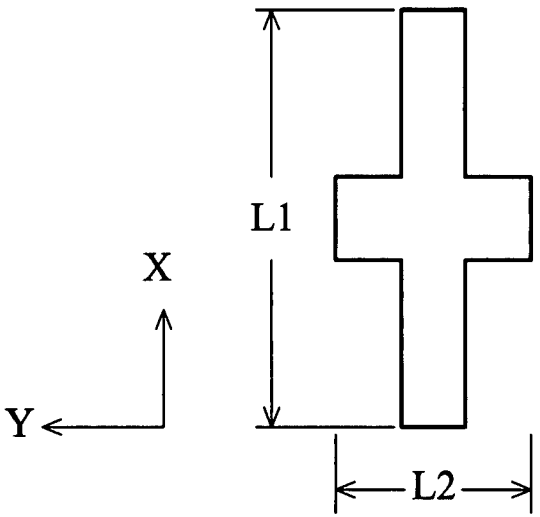
FIG. 7A is a schematic view of a through hole in an antenna assembly of the invention.
Figure 7D:
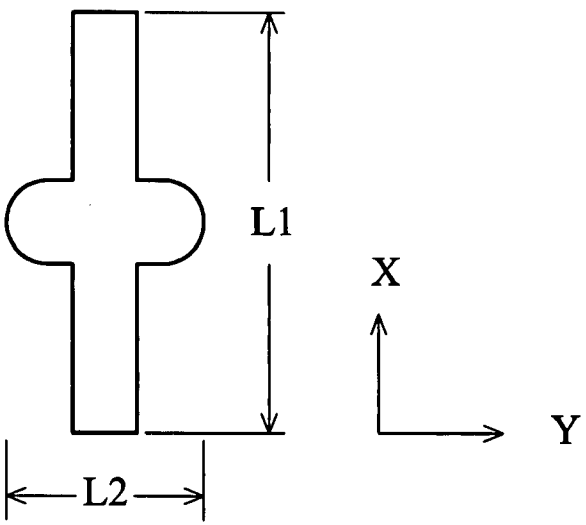
FIG. 7D is a schematic view of another through hole in an antenna assembly of the invention.
Figure 7C:
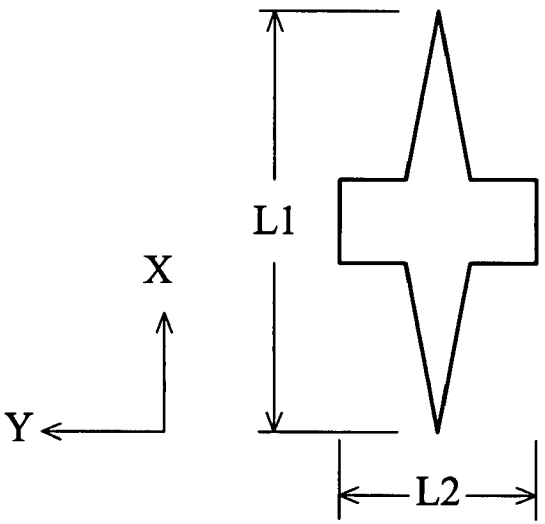
FIG. 7C is a schematic view of another through hole in an antenna assembly of the invention.

FIGS. 6A and 6B depict another feed element 34, different in that the first section S1 and the second section S2 form curved profile, such that the abutting portion 342 abuts the second surface 322 of the grounding board 32.

As mentioned, the abutting portion 342 of the feed element 34 may be flexible, forming a suitable profile so that the abutting portion 342 abuts the second surface 322 of the grounding board 32.

FIGS. 7A to 7D depict several samples of the through hole, which can vary with demands. The most important aspect is that a first length L1 in one direction of the through hole exceeds a second length L2 in another direction of the through hole. The first length L1 is substantially equal to the width of the body of the feed element, so that the feed element is not easily separated from the grounding board. Further, the second length L2 exceeds the width of the neck of the feed element to avoid short circuit caused.

While the invention has been described by way of example and in terms of preferred embodiment, it is to be understood that the invention is not limited thereto. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. An antenna assembly, comprising:

a transmission element;

a grounding board parallel to the transmission element, having a first surface, a second surface and a through hole, wherein the first surface faces the transmission element and the second surface is opposite the first surface; and a feed element connecting the transmission element wherein the feed element comprises an abutting portion passing through the through hole and abutting the second surface;

wherein the abutting portion comprises a first section and a second section connected to the first section, the first section and the second section forming a V-shaped structure.

2. The antenna assembly as claimed in claim 1, wherein the feed element comprises a body having a substantially longitudinal profile, perpendicular to the first surface and passing through the through hole.

3. The antenna assembly as claimed in claim 2, wherein the abutting portion is connected to the body.

4. The antenna assembly as claimed in claim 2, wherein the abutting portion is flexible with respect to the body to abut the second surface.

5. The antenna assembly as claimed in claim 2, wherein the body comprises a neck adjacent to the abutting portion, such that when the abutting portion abuts the second surface, the through hole encircles the neck.

6. The antenna assembly as claimed in claim 5, wherein an aperture of the through hole exceeds a width of the neck, by which a gap exists between the feed element and the grounding board.

7. The antenna assembly as claimed in claim 5, wherein a height of the neck exceeds a thickness of the grounding board.

8. The antenna assembly as claimed in claim 5, wherein the through hole has a first length in a first direction, a second length in a second direction, and the first length exceeds the second length.

9. The antenna assembly as claimed in claim 8, wherein a width of the body is substantially equal to the first length.

10. The antenna assembly as claimed in claim 8, wherein the width of the neck is less than the first and second lengths.

11. The antenna assembly as claimed in claim 8, wherein the abutting portion rotates in a third direction with respect to the body to abut the second surface, and an angle exists between the first and third directions.

12. The antenna assembly as claimed in claim 1, further comprising an insulator disposed between the transmission element and the grounding board.

13. The antenna assembly as claimed in claim 1, wherein the transmission element has a feed point, the grounding board has a connection point, and the feed element abuts the feed point and the connection point.

14. An antenna assembly, comprising:

a transmission element;

a grounding board parallel to the transmission element, having a first surface, a second surface and a through hole, wherein the first surface faces the transmission element and the second surface is opposite the first surface; and a feed element connecting the transmission element wherein the feed element comprises an abutting portion passing through the through hole and abutting the second surface;

wherein the abutting portion comprises a substantially curved profile.

15. An electronic device, comprising:

a shield; and an antenna assembly disposed in the shield, wherein the antenna assembly comprises:

a transmission element;

a grounding board parallel to the transmission element, having a first surface, a second surface and a through hole, wherein the first surface faces the transmission element and the second surface is opposite the first surface; and a feed element connecting the transmission element wherein the feed element comprises an abutting portion passing through the through hole and abutting the second surface;

wherein the abutting portion comprises a first section and a second section connected to the first section, the first section and the second section forming a V-shaped structure.

16. The electronic device as claimed in claim 15, wherein the feed element comprises:

a body having a substantially longitudinal profile, perpendicular to the first surface and passing through the through hole wherein the abutting portion is connected to the body.

17. The electronic device as claimed in claim 16, wherein the abutting portion is flexible with respect to the body to abut the second surface.

18. The electronic device as claimed in claim 16, wherein the body comprises a neck adjacent to the abutting portion, such that when the abutting portion abuts the second surface, the through hole encircles the neck.

19. The electronic device as claimed in claim 16, wherein the through hole has a first length in a first direction, a second length in a second direction, and the first length exceeds the second length.

* * * * *